US007340922B2

(12) United States Patent
La Belle

(10) Patent No.: US 7,340,922 B2
(45) Date of Patent: Mar. 11, 2008

(54) ORBIT8 EARRING

(76) Inventor: Marisa G. La Belle, 852 21st St., #C, Santa Monica, CA (US) 90403

( * ) Notice: Subject to any disclaimer, the term of this patent is extended or adjusted under 35 U.S.C. 154(b) by 130 days.

(21) Appl. No.: 11/404,757

(22) Filed: Apr. 17, 2006

(65) Prior Publication Data

US 2006/0230785 A1 Oct. 19, 2006

Related U.S. Application Data

(60) Provisional application No. 60/672,527, filed on Apr. 19, 2005.

(51) Int. Cl.
*A44C 7/00* (2006.01)

(52) U.S. Cl. ..... 63/13; 63/26

(58) Field of Classification Search ..... None
See application file for complete search history.

(56) References Cited

U.S. PATENT DOCUMENTS

| | | | | | |
|---|---|---|---|---|---|
| D14,516 | S | | 12/1883 | Van Houten | |
| D14,924 | S | | 3/1884 | Van Houten | |
| 718,708 | A | | 1/1903 | Geiger et al. | |
| 758,848 | A | | 5/1904 | Pejchar | |
| 802,267 | A | * | 10/1905 | Chaument | 63/28 |
| 922,212 | A | | 5/1909 | Tropin | |
| 1,008,419 | A | | 11/1911 | Levi | |
| 1,026,153 | A | | 5/1912 | Degner, Jr. | |
| 1,032,025 | A | * | 7/1912 | Robins | 63/28 |
| 1,561,128 | A | * | 11/1925 | Waller | 63/12 |
| 1,920,875 | A | * | 8/1933 | Miskend | 63/15 |
| D128,932 | S | | 8/1941 | Chernow | |
| D135,964 | S | | 7/1943 | De Aragon | |
| D146,495 | S | | 3/1947 | Chernow | |
| D148,136 | S | | 12/1947 | Chernow | |
| 3,533,247 | A | | 10/1970 | Douglas | |
| 3,613,393 | A | | 10/1971 | Lamoureux | |
| 4,259,850 | A | | 4/1981 | Lalieu | |
| 4,928,367 | A | | 5/1990 | Seidman | |
| 4,970,878 | A | | 11/1990 | Lee | |
| 5,577,396 | A | | 11/1996 | Cannon | |
| D394,412 | S | | 5/1998 | Hanson | |
| 5,836,176 | A | * | 11/1998 | Lichtenstein et al. | 63/13 |
| 5,946,943 | A | | 9/1999 | Hanson | |
| D414,717 | S | | 10/1999 | Comero et al. | |
| 6,058,737 | A | | 5/2000 | Domagala | |
| 6,260,382 | B1 | * | 7/2001 | Ishikawa | 63/12 |
| 6,318,122 | B1 | * | 11/2001 | Burgard | 63/29.1 |
| 6,412,304 | B1 | * | 7/2002 | Adelman | 63/26 |

* cited by examiner

*Primary Examiner*—Jack W. Lavinder
(74) *Attorney, Agent, or Firm*—Rothwell, Figg, Ernst & Manbeck, P.C.

(57) ABSTRACT

The present invention provides an earring setting for a gemstone including an arched portion, an earring wire and an end cap. The arched portion includes a hinge at one end and a mounting peg, passing through an opening in the gemstone, at the other end. The earring wire is attached to the hinge, and the end cap is attached to the mounting peg. The end cap includes an earring clasp to releasably engage the earring wire.

20 Claims, 5 Drawing Sheets

Closed Position

Open Position

ORBIT8 EARRING

CROSS-REFERENCE TO RELATED APPLICATIONS

Figures 1A, 1B:
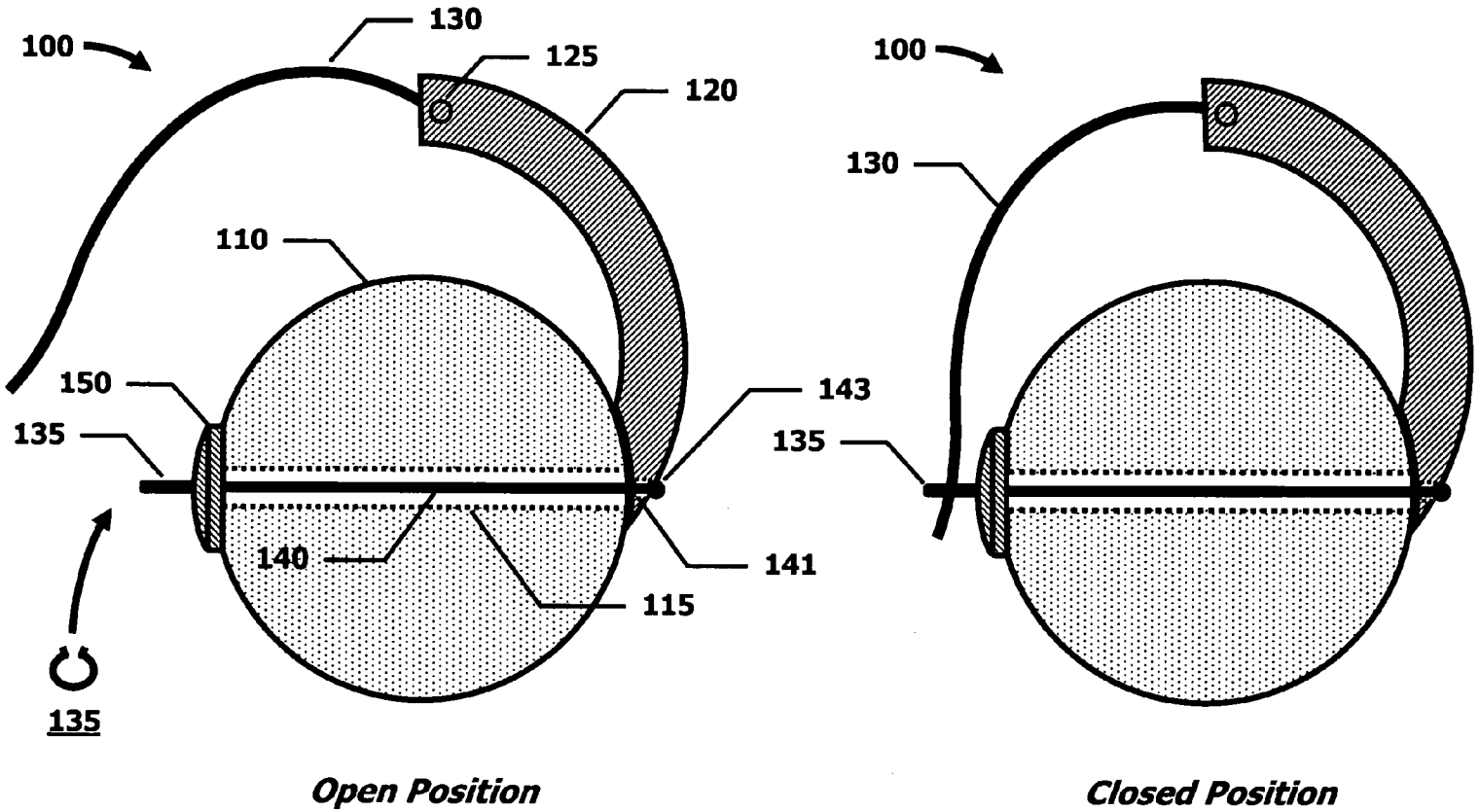

This application claims the benefit of U.S. Provisional Application No. 60/672,527, filed Apr. 19, 2005, which is incorporated herein by reference in its entirety.

BACKGROUND OF THE INVENTION

1. Field of the Invention

This invention relates to earrings, and, more particularly, to an earring utilizing a unique construction.

2. Description of Related Art

Earrings have adorned humans for a very long time. In modern times, gemstones, such as diamonds, are mounted within prong settings, which are then attached to posts for use with pierced ears. Gemstones may be similarly attached to clips for use with non-pierced ears. Vertically pendant earrings typically include a setting, such as a prong, in which the gemstone is mounted, which then hangs, dangles, or is soldered to, from a post or clip attached to the ear. Various devices may be used to hang the gemstone from the post or clip, including, for example, a precious or semi-precious metal chain, a metal link, etc. A wire and clasp arrangement may also be used to secure a pendant earring to a pierced ear. The wire, attached to one portion of the gemstone setting, is first passed through the hole in the ear and then secured within a clasp attached to another portion of the gemstone setting.

Spherical gemstones, such as pearls, may be directly mounted to earring posts or clips using various settings, such as, for example, a cap glued to the outer surface of the gemstone, a prong, a bezel, a pave, or any other well known fashion setting. Alternatively, a peg may be inserted into a hole drilled into the gemstone and then glued in place. Spherical gemstones may also be incorporated into a pendant earring design, which may include a cap glued to the outer surface of the gemstone and attached to the depending portion of the earring, such as the chain, link, etc. However, prior art spherical gemstone earring designs suffer from limited flexibility.

BRIEF SUMMARY OF THE INVENTION

Embodiments of the present invention provide an earring setting for a gemstone including an arched portion, an earring wire and an end cap. The arched portion includes a hinge at one end and a mounting peg, passing through an opening in the gemstone, at the other end. The earring wire is attached to the hinge, and the end cap is attached to the mounting peg. The end cap includes an earring clasp to releasably engage the earring wire.

BRIEF DESCRIPTION OF THE SEVERAL VIEWS OF THE DRAWING(S)

The above and other advantages of this invention will become more apparent by the following description of invention and the accompanying drawings.

FIGS. 1A and 1B present a partial cutaway view of an earring, in open and closed positions, respectively, according to an embodiment of the present invention.

Figure 2B:
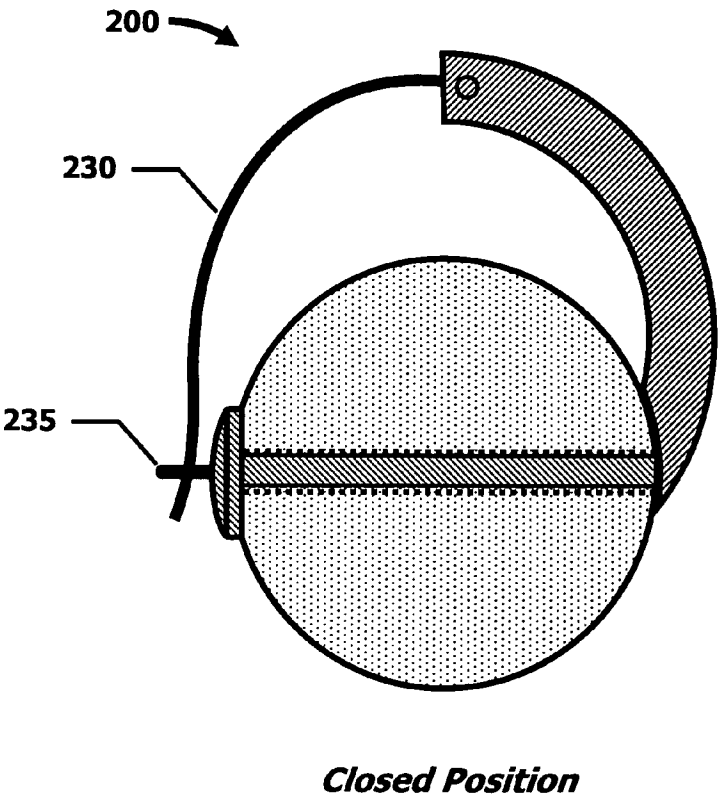
Figure 2A:
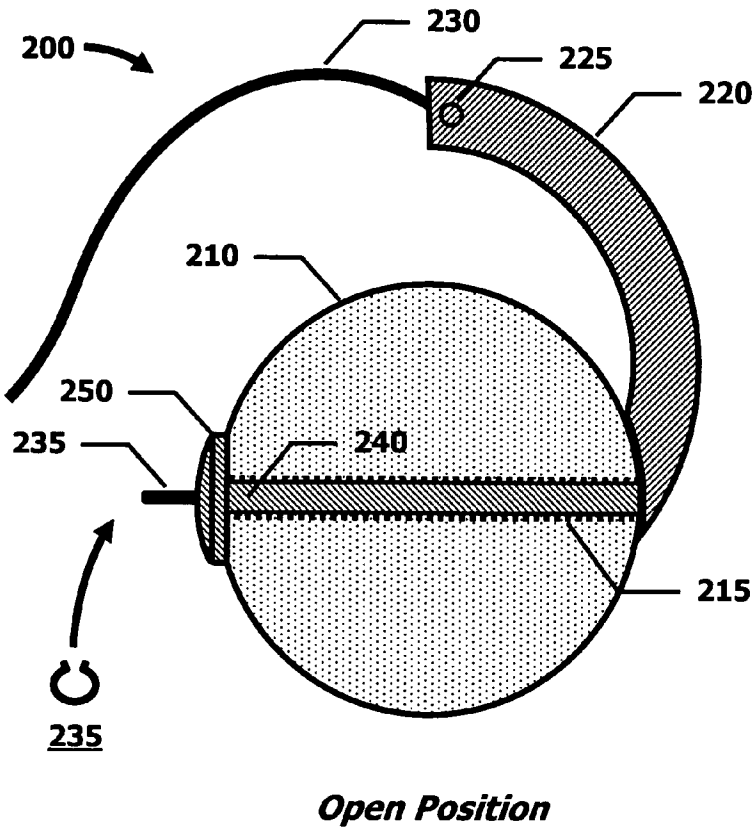

FIGS. 2A and 2B present a partial cutaway view of an earring, in open and closed positions, respectively, according to an embodiment of the present invention.

Figure 3B:
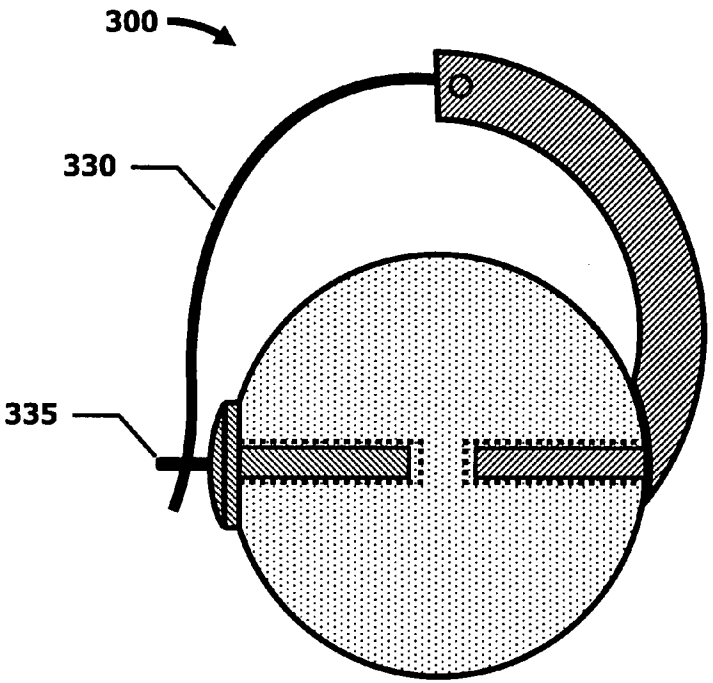
Figure 3A:
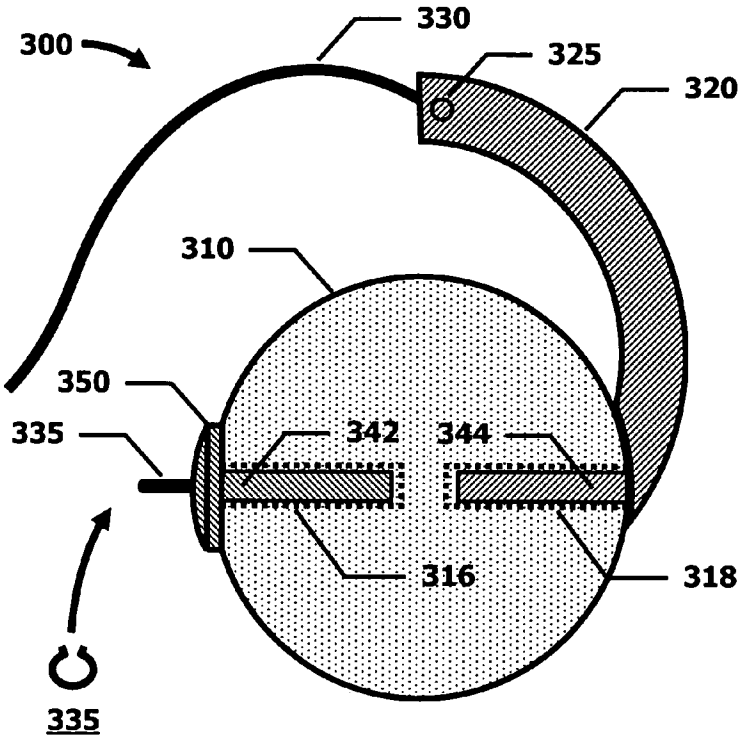

FIGS. 3A and 3B present a partial cutaway view of an earring, in open and closed positions, respectively, according to an embodiment of the present invention.

Figure 3D:
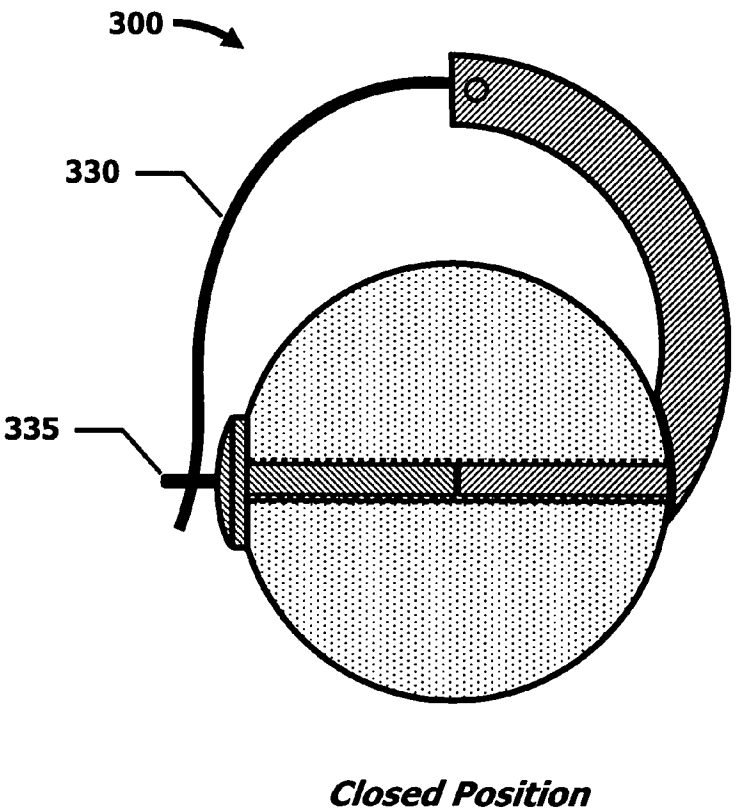
Figure 3C:
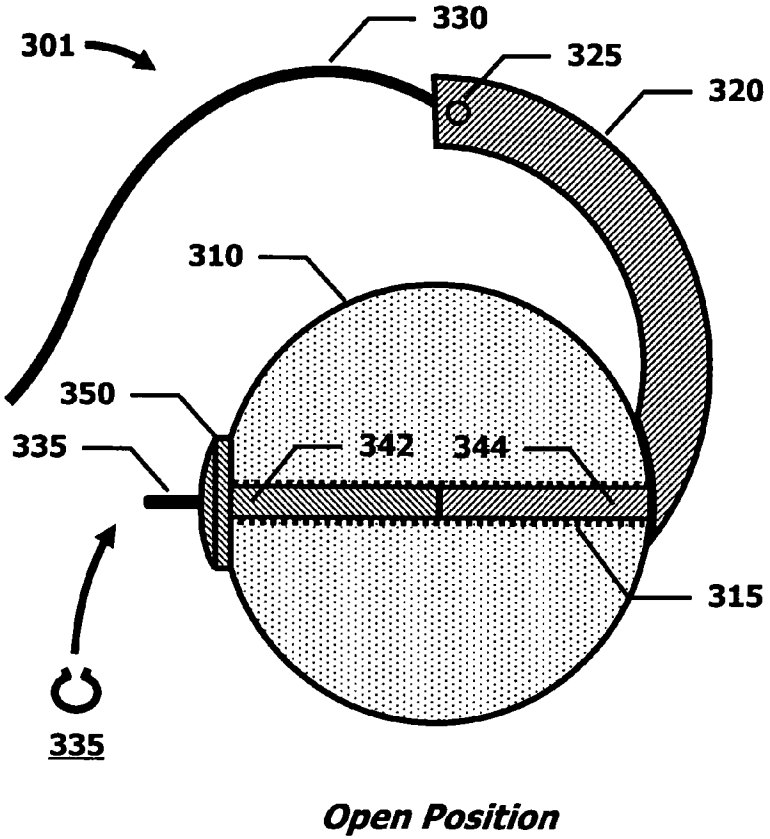

FIGS. 3C and 3D present a partial cutaway view of an earring, in open and closed positions, respectively, according to an embodiment of the present invention.

Figure 4:
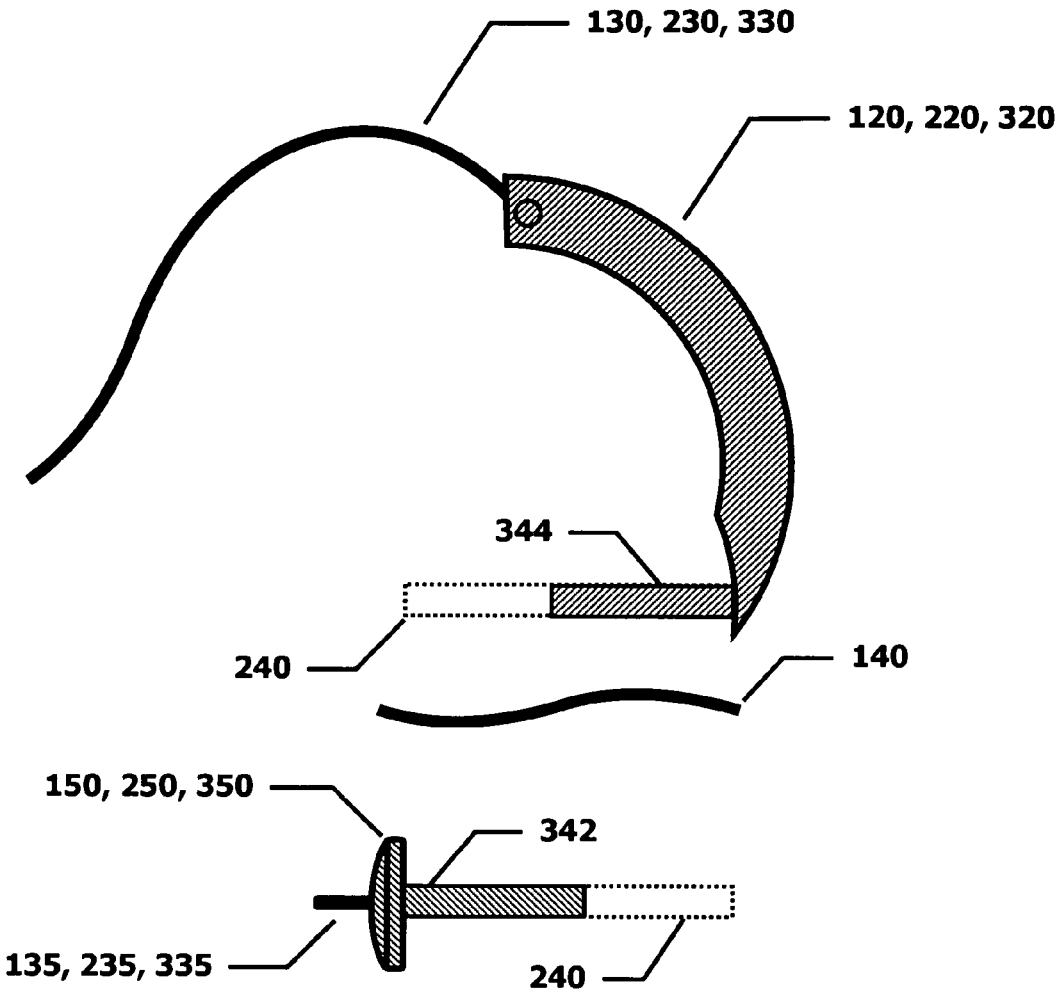

FIG. 4 depicts earring settings according to various embodiments of the present invention.

DETAILED DESCRIPTION OF THE INVENTION

FIGS. 1A and 1B present a partial cutaway view of an earring 100, in open (i.e., unclasped) and closed (i.e., clasped) positions, respectively, according to an embodiment of the present invention. The earring 100 includes a gemstone 110, or, more generally, an ornament, such as a pearl, a turquoise, a sapphire, a diamond, an artificial stone, a colored bead, etc., which is spherical in shape. While spherically-shaped gemstones comport well with the present invention, non-spherically-shaped gemstones may also be used. In the depicted embodiment, an opening 115 extends through a centerline of the gemstone 110. In other embodiments, the opening 115 may be offset from a centerline of the gemstone 110.

An arched portion 120 includes a hinge 125 at one end. In one embodiment, the arched portion 120 is semicircular, as depicted within FIGS. 1A and 1B. In other embodiments, the arched portion 120 may be completely circular, half round, triangular, square, etc. The hinge 125 may be formed using a simple rivet, a small soldered rod, etc., around which a looped end of an earring wire 130 passes. Alternatively, the end of the earring wire 130 may be hammered into a flattened portion, in which a hole may be drilled for the hinge 125 to pass through. The opposing end of the arched portion 120 abuts the gemstone 110. The arched portion 120 may be constructed of any rigid material, such as, for example, precious or semiprecious metals, wood, stone, plastic, magnetic alloy, etc. In a preferred embodiment, the arched portion 120 is constructed of gold, silver, platinum, etc., or combinations thereof. Furthermore, arched portion 120 may be inscribed with artistic designs, encrusted with precious, semi-precious or non-precious stones, etc.

A mounting wire 140, attached to the end cap 150 using, for example, a solder joint, passes through the opening 115 in the gemstone 110 to secure the gemstone 110 to the arched portion 120. The end cap 150 includes an earring clasp 135 to releasably engage the earring wire 130. In one embodiment, a u-shaped earring clasp 135 is soldered to the end cap 140; other clasp arrangements may also be employed. In another embodiment, the end cap 150, the earring clasp 135 and the mounting wire 140 may be formed from one piece of metal, i.e., e.g., a single casting.

The mounting wire 140 is attached to the arched portion 120 using, for example, a solder joint. In one embodiment, one end of the mounting wire 140 is passed through hole 141, located in the arched portion 120, and then a solder bead 143 is applied to secure the mounting wire 140 to the arched portion 120. Thus, the gemstone 110 is held against the arch portion 120, preferably in a horizontal orientation, by the tension developed within the mounting wire 140.

The mounting wire 140 may be constructed of a metal having sufficient strength to carry the tension required to maintain the rigidity of the assembled earring 100. The end cap 150 may be constructed of any rigid or semi-rigid material, such as, for example, precious or semiprecious metals, wood, stone, plastic, magnetic alloy, etc. In a preferred embodiment, the end cap 150 is constructed of gold, silver, platinum, etc., or combinations thereof.

FIGS. 2A and 2B present a partial cutaway view of an earring 200, in open (i.e., unclasped) and closed (i.e., clasped) positions, respectively, according to an embodiment of the present invention. The earring 200 includes a gemstone 210, such as a pearl, a turquoise, a sapphire, a diamond, a bead, etc., which is spherical in shape. In the depicted embodiment, an opening 215 extends through a centerline of the gemstone 210. In other embodiments, the opening 215 may be offset from a centerline of the gemstone 210 (not shown).

A ed portion 220 includes a hinge 225 at one end and a mounting peg 240 at the other end. The hinge 225 may be formed using a simple rivet, a small soldered rod, etc., around which a looped end of an earring wire 230 passes. Alternatively, the end of the earring wire 230 may be hammered into a flattened portion, in which a hole may be drilled for the hinge 225 to pass through. The opposing end of the arched portion 220 abuts the gemstone 210. The arched portion 220 may be constructed of any rigid material, such as, for example, precious or semiprecious metals, wood, stone, plastic, magnetic alloy, etc. In a preferred embodiment, the arched portion 220 is constructed of gold, silver, platinum, etc., or combinations thereof. Furthermore, arched portion 220 may be inscribed with artistic designs, encrusted with precious, semi-precious or non-precious stones, etc.

The mounting peg 240 passes through the opening 215 in the gemstone 210, supports the gemstone 210, generally, and provides a horizontal axis of rotation. In one embodiment, the mounting peg 240 is integrally formed with the arched portion 220 and attached to the end cap 250 using, for example, a solder joint, a weld, etc. In another embodiment, the mounting peg 240 is integrally formed with the end cap 250 and attached to the arched portion 220 using, for example, a solder joint, a weld, etc. If rotation of the gemstone 210 is not desired, the gemstone 210 may be fixedly secured to the mounting peg 240 using, for example, adhesive, etc.

The end cap 250 also includes an earring clasp 235 to releasably engage the earring wire 230. The end cap 250 may be constructed of any rigid or semi-rigid material, such as, for example, precious or semiprecious metals, wood, stone, plastic, magnetic alloy, etc. In a preferred embodiment, the end cap 250 is constructed of gold, silver, platinum, etc., or combinations thereof. The mounting peg 240 may be of similar construction. In one embodiment, the end cap 250, the earring clasp 235 and the mounting peg 240 may be formed from one piece of metal, i.e., e.g., a single casting.

FIGS. 3A and 3B present a partial cutaway view of an earring 300, in open (i.e., unclasped) and closed (i.e., clasped) positions, respectively, according to an embodiment of the present invention. The earring 300 includes a gemstone 310, such as a pearl, a turquoise, a sapphire, a diamond, a bead, etc., which is spherical in shape. In the depicted embodiment, two separate openings 316, 318 extend inwardly along a centerline of the gemstone 310. In other embodiments, the openings 316, 318 may be offset from a centerline of the gemstone 310 (not shown), or, the openings 316, 318 may extend completely through the centerline of the gemstone, thereby creating a single opening, such as the opening 315 depicted in FIGS. 3C and 3D.

An arched portion 320 includes a hinge 325 at one end and a mounting peg 344 at the other end. In one embodiment, the arched portion 120 is semicircular, as depicted within FIGS. 3A and 3B. In other embodiments, the arched portion 120 may be completely circular, half round, triangular, square, etc. The hinge 325 may be formed using a simple rivet, a small soldered rod, etc., around which a looped end of an earring wire 330 passes. Alternatively, the end of the earring wire 330 may be hammered into a flattened portion, in which a hole may be drilled for the hinge 325 to pass through. In one embodiment, the mounting peg 344 is integrally formed with the arched portion 320, while in another embodiment, the mounting peg 344 is attached to the arched portion 320 using, for example, a solder joint, a weld, etc. The gemstone 310 may be fixedly secured to the mounting peg 344 using, for example, adhesive, etc. The opposing end of the arched portion 320 abuts the gemstone 310. The arched portion 320 may be constructed of any rigid material, such as, for example, precious or semiprecious metals, wood, stone, plastic, magnetic alloy, etc. In a preferred embodiment, the arched portion 320 is constructed of gold, silver, platinum, etc., or combinations thereof. Furthermore, arched portion 320 may be inscribed with artistic designs, encrusted with precious, semi-precious or non-precious stones, etc.

The end cap 350 includes an earring clasp 335 to releasably engage the earring wire 330 and a mounting peg 342. In one embodiment, the mounting peg 342 is integrally formed with the end cap 350, while in another embodiment, the mounting peg 342 is attached to the end cap 350 using, for example, a solder joint, a weld, etc. The gemstone 310 may be fixedly secured to the mounting peg 342 using, for example, adhesive, etc. The end cap 350 may be constructed of any rigid or semi-rigid material, such as, for example, precious or semiprecious metals, wood, stone, plastic, magnetic alloy, etc. In a preferred embodiment, the end cap 350 is constructed of gold, silver, platinum, etc., or combinations thereof. The mounting peg 342 may be of similar construction. In one embodiment, the end cap 350, the earring clasp 335 and the mounting peg 342 may be formed from one piece of metal, i.e., e.g., a single casting.

FIGS. 3C and 3D present a partial cutaway view of the earring 301, in open (i.e., unclasped) and closed (i.e., clasped) positions, respectively, according to an embodiment of the present invention. The earring 301 includes a gemstone 310, such as a pearl, a turquoise, a sapphire, a diamond, a bead, etc., which is spherical in shape. In the depicted embodiment, an opening 315 extends through a centerline of the gemstone 310. In other embodiments, the opening 315 may be offset from a centerline of the gemstone 310 (not shown).

An arched portion 320 includes a hinge 325 at one end and a mounting peg 344 at the other end. In one embodiment, the arched portion 120 is semicircular, as depicted within FIGS. 3C and 3D. In other embodiments, the arched portion 120 may be completely circular, half round, triangular, square, etc. The hinge 325 may be formed using a simple rivet, a small soldered rod, etc., around which a looped end of an earring wire 330 passes. Alternatively, the end of the earring wire 330 may be hammered into a flattened portion, in which a hole may be drilled for the hinge 325 to pass through. In one embodiment, the mounting peg 344 is integrally formed with the arched portion 320, while in another embodiment, the mounting peg 344 is attached to the arched portion 320 using, for example, a solder joint, a weld, etc. The opposing end of the arched portion 320 abuts the gemstone 310. The arched portion 320 may be constructed of any rigid material, such as, for example, precious or semiprecious metals, wood, stone, plastic, magnetic alloy, etc. In a preferred embodiment, the arched portion 320 is constructed of gold, silver, platinum, etc., or combinations thereof. Furthermore, arched portion 320 may be inscribed with artistic designs, encrusted with precious, semi-precious or non-precious stones, etc.

The end cap 350 includes an earring clasp 335 to releasably engage the earring wire 330 and a mounting peg 342. In one embodiment, the mounting peg 342 is integrally formed with the end cap 350, while in another embodiment, the mounting peg 342 is attached to the end cap 350 using, for example, a solder joint, a weld, etc. The end cap 350 may be constructed of any rigid or semi-rigid material, such as, for example, precious or semiprecious metals, wood, stone, plastic, magnetic alloy, etc. In a preferred embodiment, the end cap 350 is constructed of gold, silver, platinum, etc., or combinations thereof. The mounting peg 342 may be of similar construction. In one embodiment, the end cap 350, the earring clasp 335 and the mounting peg 342 may be formed from one piece of metal, i.e., e.g., a single casting.

Rather than securing the mounting pegs 342, 344 directly to the gemstone 310, in one embodiment, the mounting pegs 340, 342 are formed from a magnetic alloy, such as, for example, platinum and cobalt, extend to the center of the gemstone 310 and are magnetically polarized in opposing directions. Accordingly, when the mounting pegs 340, 342 are inserted into the gemstone 310, the ends of the mounting pegs 340, 342 are magnetically attracted to one another, thereby securing the gemstone 100 to the arched portion 320. Advantageously, the gemstone 310 is free to rotate about a horizontal axis formed by the magnetized mounting pegs 340, 342. Of course, as noted above, the arched portion 320, the end cap 350 and the earring wire 330 may all be formed from a magnetic alloy. In another embodiment, only the ends of the mounting pegs 340, 342 are magnetized in order to secure the gemstone 310 to the arched portion 320.

FIG. 4 depicts the various elements of earrings 100, 200, 300 and 301 prior to mounting the gemstone, including, for example, the arched portions 120, 220, 320, the earring wires 130, 230, 330, the clasps 135, 235, 335, the end caps 150, 250, 250, etc.

While this invention has been described in conjunction with specific embodiments thereof, many alternatives, modifications and variations will be apparent to those skilled in the art. Accordingly, the preferred embodiments of the invention as set forth herein, are intended to be illustrative, not limiting. Various changes may be made without departing from the true spirit and full scope of the invention as set forth herein.

What is claimed is:

1. An earring, comprising:
an ornament having an opening therethrough; and
a setting, including:
an arched portion having a hinge at one end,
an earring wire attached to the hinge,
an end cap having an earring clasp to releasably engage the earring wire, and
a mounting wire, attached to the arched portion and the end cap, passing through the opening in the ornament.

2. The earring of claim 1, wherein the ornament is spherical and the opening extends through a centerline of the ornament.

3. The earring of claim 2, wherein the ornament is a pearl.

4. The earring of claim 3, wherein the earring wire, the arched portion and the end cap are precious metals.

5. The earring of claim 4, wherein the arched portion includes encrusted gemstones.

6. The earring of claim 1, wherein the hinge is a rivet and an end of the earring wire forms a loop around the rivet.

7. The earring of claim 1, wherein the earring clasp is soldered to the end cap, and the mounting wire is soldered to the end cap and the arched portion.

8. The earring of claim 1, wherein the mounting wire carries a tensile load.

9. An earring setting for a gemstone, comprising:
an arched portion, including:
a hinge formed at one end, and
a mounting peg, passing through an opening in the gemstone, at the other end;
an earring wire attached to the hinge;
an end cap, including an earring clasp to releasably engage the earring wire, attached to the mounting peg.

10. The earring setting of claim 9, wherein the mounting peg provides a horizontal axis of rotation for the gemstone.

11. The earring setting of claim 9, wherein the mounting peg is integrally formed at the other end of the arched portion and attached to the end cap using a solder joint.

12. The earring setting of claim 9, wherein the mounting peg is integrally formed at the end cap and attached to the arched portion using a solder joint.

13. The earring setting of claim 9, wherein the earring wire, the arched portion and the end cap are precious metals and the arched portion includes encrusted gemstones.

14. The earring setting of claim 9, wherein the hinge is a rivet and an end of the earring wire forms a loop around the rivet.

15. An earring setting for a gemstone, comprising:
an arched portion, including:
a hinge at one end, and
a mounting peg, secured within a first opening in the gemstone, at the other end;
an earring wire attached to the hinge; and
an end cap, including:
an earring clasp to releasably engage the earring wire, and
a mounting peg secured within a second opening in the gemstone.

16. The earring setting of claim 15, wherein the mounting pegs are secured within the openings of the gemstone using adhesive.

17. The earring setting of claim 15, wherein the first and second openings form a continuous opening through the gemstone.

18. The earring setting of claim 15, wherein the earring wire, the arched portion and the end cap are precious metals and the arched portion includes encrusted gemstones.

19. The earring setting of claim 15, wherein the hinge is a rivet and an end of the earring wire forms a loop around the rivet.

20. The earring setting of claim 15, wherein arched portion is semicircular.

* * * * *